United States Patent [19]

Szeker et al.

[11] 4,414,615

[45] Nov. 8, 1983

[54] MOUNTING STRUCTURE FOR A HIGH PRESSURE SODIUM LAMP

[75] Inventors: George Szeker, Toronto; Charles G. Shepherd, Oakville, both of Canada

[73] Assignee: U.S. Philips Corporation, New York, N.Y.

[21] Appl. No.: 299,437

[22] Filed: Sep. 4, 1981

[30] Foreign Application Priority Data

Sep. 18, 1980 [CA] Canada ..... 360480

[51] Int. Cl.[3] ..... F21K 7/00

[52] U.S. Cl. ..... 362/264; 362/263; 362/265; 362/294; 362/373

[58] Field of Search ..... 362/263, 264, 265, 294, 362/373

[56] References Cited

U.S. PATENT DOCUMENTS 4,054,790 10/1977 Slaughter ..... 362/265 X 4,363,086 12/1982 Fletcher ..... 362/263 X

*Primary Examiner*—Stephen J. Lechert, Jr.

*Attorney, Agent, or Firm*—Robert S. Smith

[57] ABSTRACT

A mounting arrangement for auxiliary operating components for a high-pressure vapor discharge lamp in a standard inverted cup-shaped mounting structure for an incandescent street lamp comprises a U-shaped bracket attached by a leg of the bracket to the interior of the structure with one leg of the bracket being centrally located in an open end of the structure. A holder for the lamp is attached to the leg of the bracket located in the open end and a reflecting metallic heat shield closes the remaining portion of the open end. One of the auxiliary components is a capacitor which is attached to the other side of this leg and in the interior of the structure by a mounting strap which spaces the capacitor from contact with other components and the structure to limit transfer of heat to the capacitor. In order to further limit transfer of heat to the capacitor, the mounting strap is provided with a plurality of small indentations spaced so the indentations support the capacitor within the strap, only the outside surface of the capacitor being in contact with the bottom of the indentations.

12 Claims, 2 Drawing Figures

MOUNTING STRUCTURE FOR A HIGH PRESSURE SODIUM LAMP

Figure 1:
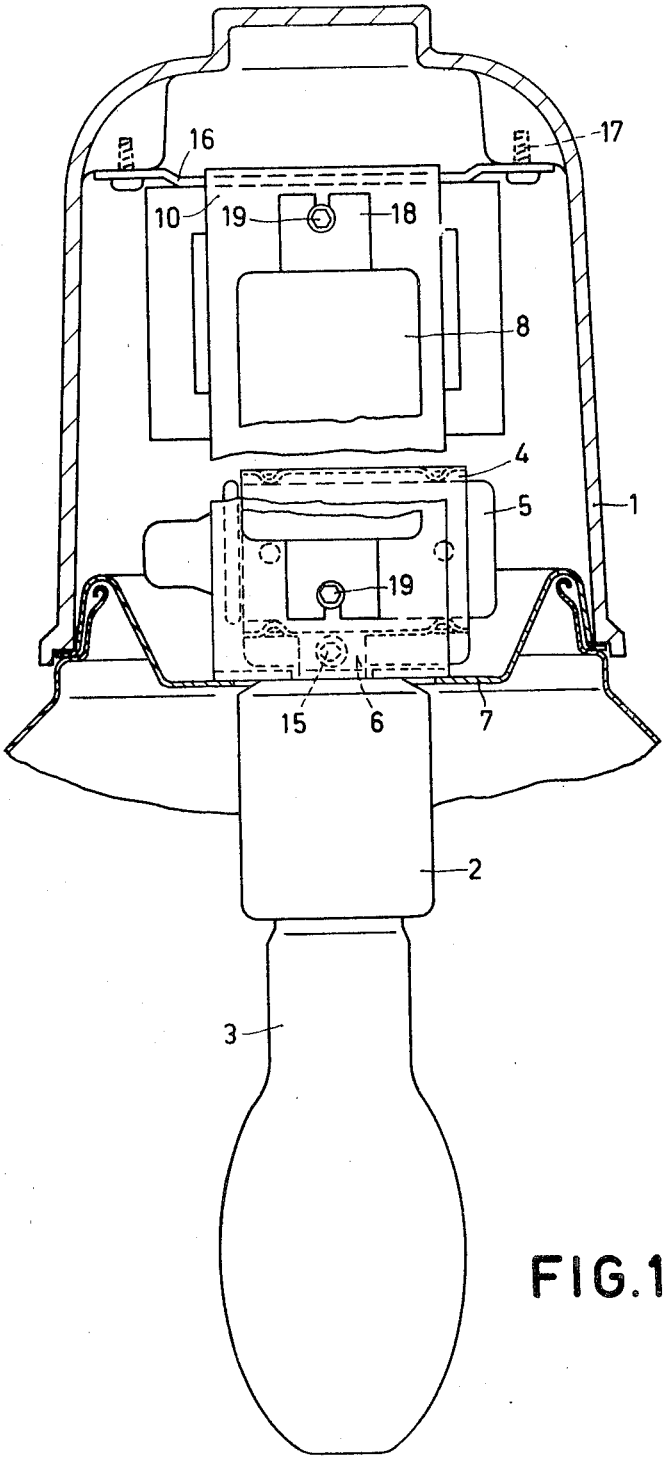

The invention relates to a mounting structure for a high pressure Na vapor discharge lamp and a particular arrangement for the mounting of the auxiliary operating components for the lamp. The invention provides an arrangement whereby a high pressure Na vapor discharge lamp can be mounted in a standard mounting for an incandescent type street lamp with the auxiliary components being mounted inside the standard mounting. The particular arrangement is such that the necessary space required for the mounting of the components is minimized and at the same time the components are not subjected to a temperature which would result in any thermal damage.

U.S. Pat. No. 3,317,724, which issued to Pfaff and Kendall on May 2, 1967, shows one particular type of mounting post for a street lamp with electrical accessories mounted on the inside wall of the post. The type of mounting arrangement for auxiliary components according to the present invention is designed to enable the electrical accessories to be mounted in a minimum size space while at the same time keeping the temperature of the accessories within tolerable limits. This is accomplished by the use of a metallic reflecting heat shield placed between the lamp and accessories and the use of a particular type of mounting strap for one of the auxiliary components, i.e. the capacitor.

The arrangement according to an embodiment of the present invention is particularly designed so that a high pressure Na vapour discharge lamp can be mounted in a standard mounting for an incandescent type street lamp. The space inside this standard mounting is of sufficient size to mount the auxiliary operating components and with the particular arrangement of mounting the temperature of the electronic components can be kept within tolerable limits. In order to limit the transfer of heat from the lamp to the components, a metallic reflecting heat shield is located between the lamp and components and attached to the outside surface of the mounting structure and type of mounting strap is used for the capacitor which minimizes the amount of transfer of heat from the lamp and the heat shield to the capacitor.

U.S. Pat. No. 3,189,961, which issued to R. V. Heller on June 22, 1965, shows a clamp somewhat similar to that used as a mounting strap for the capacitor according to the present invention. The clamp shown in U.S. Pat. No. 3,189,961 shows a corrugated surface with ridges along the surface of the clamp. These ridges are used to make the clamp more flexible.

The mounting for a standard type incandescent street lamp consists of an inverted cup shaped cast aluminium structure. The auxiliary operating components for a high pressure Na discharge lamp can be mounted inside this structure by fastening a first leg of a U-shaped bracket to the inside top of the structure with the base of the bracket being spaced from the wall of the structure and the other leg of the U-shaped bracket being centrally located at the open end of the structure. A transformer is attached to the first leg of the bracket, while a starting electronic component is attached to the base of this bracket and positioned so that it is located between the base of the bracket and the closest wall of the structure. A capacitor is attached to the other leg of the bracket by means of a mounting strap so that it is located adjacent the transformer and a holder for the lamp is attached to the other surface of the leg and extends outside the structure. The space between the holder and the wall of the structure is closed by a heat shield of reflecting metal which minimizes the transfer of heat by radiation to the inside portion of the structure but does conduct heat to the exterior wall of the structure and to the reflector lens assembly so that it will be radiated to the surroundings.

In a mounting arrangement, according to the present invention, the auxiliary operating components for a high-pressure vapor discharge lamp are mounted in a standard inverted cup-shaped mounting structure for an incandescent street lamp by means of a U-shaped bracket attached by a leg of the bracket to the inside of the structure with one leg of the U-shaped bracket being centrally located in an open end of the structure from which a holder for the lamp projects outwardly, a reflecting metallic heat shield closing the remaining portion of the open end of the structure, one of the components being a capacitor which is mounted inside the structure adjacent the holder by a mounting strap which spaces the capacitor from contact with the other components and structure to limit transfer of heat to the capacitor.

In a further feature, the base of the U-shaped bracket is spaced from a wall of the structure and a starting component is mounted on the base between the wall and the base of the bracket, another leg of the bracket is attached to the inside top portion of the structure with a transformer mounted on this leg of the U-shaped bracket internally of the U-shape.

In a further feature, the leg of the bracket attached to the inside top portion of the structure is attached by means of another bracket which is attached to this leg at right angles to the length of this leg and the outer edge of this last-mentioned bracket is attached to the inside top portion of the mounting structure.

In a further feature of the invention, the mounting strap for the capacitor is resilient and shaped to encircle the outside surface of the capacitor and the strap is provided with a plurality of small indentations spaced so that the indentations support the capacitor within the strap with only the outside surface of the capacitor being in contact with the bottom of the indentations. This arrangement provides much less surface contact with the mounting strap then would be provided by a flat clamp and hence less area for the transfer of heat from the mounting strap to the capacitor while at the same time allowing ready radiation of heat from the capacitor.

In a further feature of the invention the ends of the mounting strap are bent at right angles to adjacent portions of the strap and extend outwards parallel to each other each end of the strap containing an aperture, the apertures being coaxial with a fastening device extending through these apertures and through an aperture in a tab on the mounting bracket, the fastening device applying pressure to the ends of the strap so that the capacitor is clamped within the strap.

Figure 2:
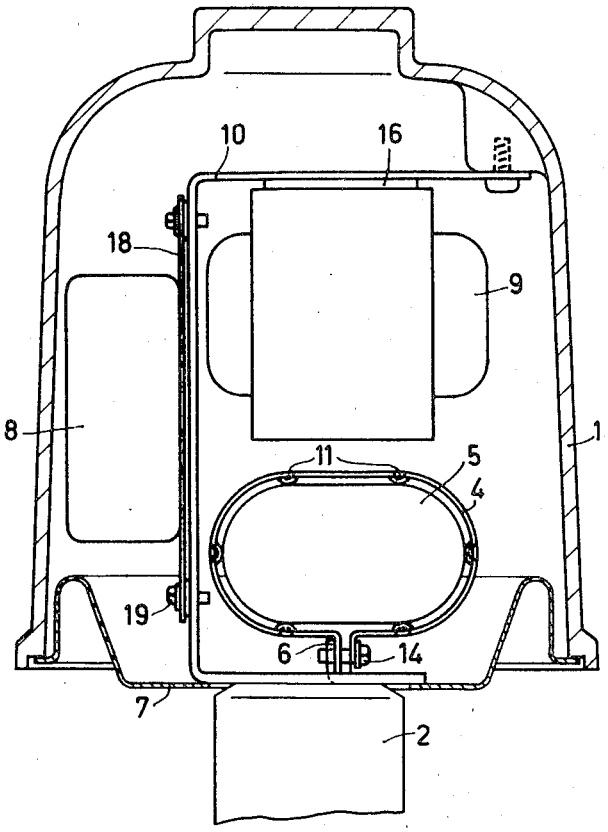

The invention will now be described in more detail with reference to the accompanying drawings in which:

FIGS. 1 and 2 show, in cross-section, a mounting structure for a gas discharge lamp with ballast components mounted inside the structure.

The mounting structure 1, commonly used for incandescent street lamps, is in the form of an inverted cup and made of cast aluminium. Auxiliary operating components such as transformer 9, starter 8 and capacitor 5 for a high pressure Na discharge lamp are shown mounted inside this type of a structure. To mount these auxiliary components in the structure 1, a bracket plate 16 is attached to the inside bottom of the structure 1 by means of screws 17 and one leg of a U-shaped bracket 10 is fastened to the bracket 16 so that the other leg of bracket 10 is centrally located at the open end of the structure 1.

A holder 2 for a gas discharge lamp 3 is attached to the other leg of bracket 10 and extends away from the structure 1. A heat reflecting dish-like shield 7 of aluminium closes the remaining portion of the open end so as to minimize heat radiation from lamp 1 towards the interior of the structure. The outer edge of shield 7 has a V-shaped recess in order to accommodate a reflector assembly including a transparent glass refractor for the street lamp. The shield conducts heat to the exterior wall of the structure and to the lens assembly so that it will be readily radiated to the surroundings.

The transformer 9 is mounted on the bracket 16 and the base portion of bracket 10 is spaced from the wall of structure 1 with an electronic starting component 8 mounted on this base, between the base and wall, by means of a metal strap 18 and screws 19.

The leg of bracket 10 to which the lampholder 2 is attached has a portion cut out and bent to form a tab 6 which extends towads the interior of the structure 1. The tab 6 is provided with an aperture 15 so that a mounting strap 4 for capacitor 5 can be attached to the tab 6 by a screw 14.

The capacitor 5 has the form of a flattened cylinder with mainly flat sides and rounded edges. The mounting strap 4 is resilient and formed into a similar, but slightly larger, shape as the capacitor 5 with the ends 12 of the strap bent outward so that they extend parallel to each other and are slightly spaced apart.The ends 12 of the strap 4 are each provided with an aperture which are adjacent to each other and arragned to accept a clamping screw 14.

Small indentations 11 are provided in the surface of the metallic strap 4 and extend inwards. These indentations 11 are spaced along each edge of strap 4 so that they will support the capacitor 5 and maintain the outside surface of capacitor 5 spaced apart from the major surface of strap 4. When mounted, the capacitor 5 only touches the mounting strap 4 at the small areas formed by the bottoms of indentations 11 so that the amount of heat transfer from strap 4 to capacitor 5 is minimized in order to prevent thermal damage to the capacitor. The metallic heat shield 7 also helps limit the amount of heat transferred from lamp 3 to the interior of the mounting structure.

In mounting the capacitor 5 in the structure, aperture in the ends 12 of the strap 4 are aligned with an aperture 15 in tab 6 and screw 14 is used to fasten the strap 4 to tab 6. The screw 14 also applies pressure to the portions 12 forcing these towards each other resulting in the capacitor 5 being clamped within the strap 4. This mounting arrangement places the capacitor 5 in between the transformer 9 and the leg of bracket 10 to which the lampholder 2 is attached.

This particular type of arrangement results in the required space for mounting the auxiliary operating components 5, 8 and 9 being minimized and at the same time maintains the oeprating temperature of these components within the required limits so as to prevent any thermal damage to the components. This arrangement makes it possible to mount the auxiliary operating components for a high pressure Na discharge lamp inside a standard type mounting structure for an incandescent type street lamp.

The particular arrangement described can be varied without departing from the spirit of the invention as defined in the following Claims.

What is claimed is:

1. A mounting arrangement for auxiliary operating components for an associated high-pressure vapor discharge lamp which comprises: an inverted open ended cup-shaped mounting structure, a U-shaped bracket having a base section from which elongated first and second legs extend, said first leg being attached to the interior of said structure and said second leg being substantially centrally located in the open end of said structure, a holder for the associated lamp being attached to said second leg and projecting outwardly from said cup-shaped mounting structure, and a reflecting metallic heat shield extending around said U-shaped bracket and closing the open end of said structure, the mounting arrangement also including a capacitor which is attached to the other side of said second leg in the interior of said structure by a mounting strap which spaces the capacitor from contact with other components and includes means to limit transfer of heat to said capacitor.

2. A mounting arrangement as claimed in claim 1 in which said base of said U-shaped bracket is spaced from the wall of said structure and a starting component is mounted on said base between said wall and said base of said U-shaped bracket.

3. A mounting arrangement as claimed in claim 2 in which said second leg of said bracket is attached to the interior of said structure proximate to the inside normally uppermost portion of said structure with a transformer mounted on said first leg inernally of the U-shape.

4. A mounting arrangement as claimed in claim 1 in which said first leg of said U-shaped bracket attached to the inerior of said structure is attached to the inside normally uppermost portion of said structure by means of a second bracket which is attached to said first leg at right angles to the axial extent of said first leg and the outer edge of said second bracket is attached to the inside top portion of said mounting structure.

5. A mounting arrangement as claimed in claim 2 in which said first leg of said U-shaped bracket attached to the interior of said structure is attached to the inside normally uppermost portion of said structure by means of a second bracket which is attached to said first leg at right angles to the axial extent of said first leg and the outer edge of said second bracket being attached to the inside top portion of said mounting structure.

6. A mounting arrangement as claimed in claim 3 in which said first leg of said U-shaped bracket attached to the interior of said structure is attached to the inside normally uppermost portion of said structure by means of a second bracket which is attached to said first leg at right angles to the axial extent of said first leg and the outer edge of said second bracket is attached to the inside top portion of said mounting structure.

7. A mounting arrangement as claimed in claim 1 in which said mounting strap for said capacitor is resilient and shaped to encircle the outside surface of said capacitor and said strap is provided with a plurality of small indentations spaced so that the indentations support the capacitor within the strap with the only portion of said strap in contact with said capacitor being said indentations.

8. A mounting arrangement as claimed in claim 2 in which said mounting strap for said capacitor is resilient and shaped to encircle the outside surface of said capacitor and said strap is provided with a plurality of small indentations spaced so that the indentations support the capacitor within the strap with the only portion of said strap in contact with said capacitor being said indentations.

9. A mounting arrangement as claimed in claim 3 in which said mounting strap for said capacitor is resilient and shaped to encircle the outside surface of said capacitor and said strap is provided with a plurality of small indentations spaced so that the indentations support the capacitor within the strap with the only portion of said strap in contact with said capacitor being said indentations.

10. A mounting arrangement as claimed in claim 1 in which said mounting strap for said capacitor is resilient and shaped to encircle the outside surface of the capacitor and said strap is provided with a plurality of small indentations spaced so the indentations support said capacitor within the strap, the ends of said strap being bent at right angles to adjacent portions of said strap and extend outward in mutually parallel relationship, said mounting bracket including a tab having an aperture, each end having an aperture which is coaxial with a fastening device extending through said apertures in said ends and through said aperture in said tab on said mounting bracket, said fastening device applying pressure to the ends of said strap so that said capacitor is clamped within said strap.

11. A mounting arrangement as claimed in claim 2 in which said mounting strap for said capacitor is resilient and shaped to encircle the outside surface of the capacitor and said strap is provided with a plurality of small indentations spaced so the indentations support said capacitor within the strap, the ends of said strap being bent at right angles to adjacent portions of said strap and extend outward in mutually parallel relationship, said mounting bracket including a tab having an aperture, each end having an aperture which is coaxial with a fastening device extending through said apertures in said ends and through said aperture in said tab on said mounting bracket, said fastening device applying pressure to the ends of said strap so that said capacitor is clamped within said strap.

12. A mounting arrangement as claimed in claim 3 in which said mounting strap for said capacitor is resilient and shaped to encircle the outside surface of the capacitor and said strap is provided with a plurality of small indentations spaced so the indentations support said capacitor within the strap, the ends of said strap being bent at right angles to adjacent portions of said strap and extend outward in mutually parallel relationship, said mounting bracket including a tab having an aperture, each end having an aperture which is coaxial with a fastening device extending through said apertures in said ends and through said aperture in said tab on said mounting bracket, said fastening device applying pressure to the ends of said strap so that said capacitor is clamped within said strap.

* * * * *